US009933228B2

(12) United States Patent
McPherson

(10) Patent No.: US 9,933,228 B2
(45) **Date of Patent: *Apr. 3, 2018**

(54) ARCHERY BOWSTRING WEIGHT

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/452,249

(22) Filed: Mar. 7, 2017

(65) Prior Publication Data

US 2017/0176128 A1 Jun. 22, 2017

Related U.S. Application Data

(63) Continuation of application No. 14/481,374, filed on Sep. 9, 2014, now Pat. No. 9,587,902, which is a continuation of application No. 12/845,427, filed on Jul. 28, 2010, now Pat. No. 8,826,896, which is a continuation-in-part of application No. 29/355,275, filed on Feb. 4, 2010, now Pat. No. Des. 650,036.

(51) Int. Cl.
*F41B 5/00* (2006.01)
*F41B 5/14* (2006.01)

(52) U.S. Cl.
CPC ..... *F41B 5/1411* (2013.01); *F41B 5/1403* (2013.01); *F41B 5/1426* (2013.01)

(58) Field of Classification Search
CPC .... F41B 5/1407; F41B 5/1411; F41B 5/1415; F41B 5/1419; F41B 5/1423; Y10S 285/903; B43K 29/02
See application file for complete search history.

(56) References Cited

U.S. PATENT DOCUMENTS

| | | | |
|---|---|---|---|
| 682,299 | A | 9/1901 | Walsh |
| 840,372 | A | 1/1907 | Reckendorfer |
| D123,490 | S | 11/1940 | Saffell |
| 2,777,437 | A | 7/1957 | Allen |
| 2,910,058 | A | 10/1959 | Bender |
| 2,956,560 | A | 10/1960 | Stockfleth |
| 2,968,849 | A | 1/1961 | Cain |
| 3,010,447 | A | 11/1961 | Roemer |
| 3,059,629 | A | 10/1962 | Stinson |
| 3,331,720 | A | 7/1967 | Watson |
| 3,340,862 | A | 9/1967 | Saunders |
| 3,375,815 | A | 4/1968 | Novak |
| 3,486,495 | A | 12/1969 | Allen |
| 3,507,525 | A | 4/1970 | Sable |
| 3,584,615 | A | 6/1971 | Stinson |
| 3,612,029 | A | 10/1971 | Carroll et al. |
| D226,429 | S | 3/1973 | Christen |
| 3,756,214 | A | 9/1973 | Christen |
| 3,756,215 | A | 9/1973 | Black |
| 3,837,327 | A | 9/1974 | Saunders et al. |
| 3,937,205 | A | 2/1976 | Saunders |
| 4,023,551 | A | 5/1977 | Huddleston |
| 4,050,334 | A | 9/1977 | Davis, Jr. |

(Continued)

*Primary Examiner* — John Ricci

(57) ABSTRACT

A weight for an archery bowstring comprises a tubular shape defining an internal cavity. The weight can comprise a single piece of material. The weight desirably frictionally engages a bowstring and has the same shape before and after installation. The weight comprises a continuous structure surrounding the bowstring that will not become detached.

18 Claims, 4 Drawing Sheets

(56) References Cited

U.S. PATENT DOCUMENTS

| | | | |
|---|---|---|---|
| 4,079,722 | A | 3/1978 | Griggs |
| 4,080,951 | A | 3/1978 | Bateman, III |
| D266,179 | S | 9/1982 | Peck |
| 4,539,970 | A | 9/1985 | Griz |
| 4,909,233 | A | 3/1990 | Stephenson |
| 5,016,604 | A | 5/1991 | Tilby |
| D322,022 | S | 12/1991 | Cunningham et al. |
| D343,234 | S | 1/1994 | Williams |
| D344,123 | S | 2/1994 | Bertram |
| 5,287,842 | A | 2/1994 | Saunders |
| 5,368,006 | A | 11/1994 | McPherson |
| 5,390,657 | A | 2/1995 | Larson |
| 5,606,963 | A | 3/1997 | Wenzel et al. |
| 5,680,851 | A | 10/1997 | Summers |
| D410,272 | S | 5/1999 | Fitzgerald, Jr. |
| RE36,555 | E | 2/2000 | Tentler |
| D426,612 | S | 6/2000 | Primeau, IV |
| 6,315,715 | B1 | 11/2001 | Taylor et al. |
| 6,443,139 | B1 | 9/2002 | McPherson |
| 6,607,010 | B1 | 8/2003 | Kashy |
| 6,761,158 | B2 | 7/2004 | Wright |
| D503,769 | S | 4/2005 | Korn et al. |
| 7,082,937 | B1 | 8/2006 | Land |
| 7,232,597 | B2 | 6/2007 | Iwata et al. |
| D546,659 | S | 7/2007 | Smith |
| D600,773 | S | 9/2009 | Hall |
| D627,460 | S | 11/2010 | Horton |
| D629,896 | S | 12/2010 | Horton |
| 7,871,344 | B1 | 1/2011 | Massman |
| D650,036 | S | 12/2011 | McPherson |
| 8,826,896 | B1 | 9/2014 | McPherson |
| 9,587,902 | B2 | 3/2017 | McPherson |
| 2006/0011190 | A1 | 1/2006 | Andrews |
| 2009/0107474 | A1 | 4/2009 | Silverson |
| 2010/0089375 | A1 | 4/2010 | McPherson et al. |
| 2010/0319670 | A1 | 12/2010 | Sims et al. |

ARCHERY BOWSTRING WEIGHT

CROSS REFERENCE TO RELATED APPLICATIONS

This Application is a continuation of U.S. patent application Ser. No. 14/481,374, filed Sep. 9, 2014, now U.S. Pat. No. 9,587,902, which is a continuation of U.S. patent application Ser. No. 12/845,427, filed Jul. 28, 2010, now U.S. Pat. No. 8,826,896, which is a continuation-in-part of U.S. application Ser. No. 29/355,275, filed Feb. 4, 2010, the entire disclosures of which are hereby incorporated herein by reference.

BACKGROUND OF THE INVENTION

The present invention generally relates to a bow, such as a compound bow, having weights on the bowstring to enhance the bow's performance. It is known in the art that placing some weight at proper positions on the bowstring can enhance the performance of the bows. Previously, multiple metal weights have been individually clamped or crimped onto the bowstring. Prior methods of placement can be imprecise, and in some cases, individual weights can migrate or even become disengaged from the bowstring, for example as the bow is fired.

There remains a need for bowstring weights that are functional, aesthetic and safer than previous designs.

All US patents and applications and all other published documents mentioned anywhere in this application are incorporated herein by reference in their entirety.

Without limiting the scope of the invention, a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is also provided for the purposes of complying with 37 C.F.R. § 1.72. The abstract is not intended to be used for interpreting the scope of the claims.

BRIEF SUMMARY OF THE INVENTION

An archery bow comprises at least a riser portion, a first limb connected at a first end of the riser portion, a second limb connected at a second end of the riser portion, and a bowstring extending between the first limb and the second limb. The bowstring has a first end and a second end. At least one bowstring weight has a center of mass attached to the bowstring at a location that is less than ⅓ of the distance between the first end and the second end when the bow is in an undrawn state.

In at least one embodiment, the bowstring weight has an internal bore, and the bowstring passes through the internal bore. In at least one embodiment, the bowstring weight is attached to the bowstring by an adhesive.

In at least one embodiment, the bowstring weight comprises a polymer material. In at least one embodiment, the bowstring weight consists of a polymer material.

The weight preferably comprises a continuous structure surrounding the bowstring, which will not become detached. Preferably, the weight retains the same shape and shape configuration prior to and after being installed on a bowstring.

In at least one embodiment, the bowstring weight has a plurality of shapes selected from a group consisting of cubes, rectangular prisms, cylinders and spheres.

In at least one embodiment, the bowstring weight has a wave-like profile, wherein the wave-like profile is comprised of a plurality of alternating first sections and second sections, wherein the first section and the section are of distinguishable shapes.

In at least one embodiment, the bow further comprises a bowstring bulge, wherein the bowstring weight engages with the bowstring bulge.

In at least one embodiment, the weight comprises a cylindrical member made from a polymer material. The polymer material is resilient enough to have the bowstring pulled through the internal bore, but rigid enough to provide resistance to bending along the length of the bowstring weight. In at least one embodiment, the cylindrical member has an internal bore through the axis of the cylindrical member and a wave-like outer profile, wherein the wave-like profile is comprised of a plurality of alternating first sections and second sections of a material. In at least one embodiment, the first section has a smooth concave shape and the second section has a substantially cylindrical shape.

In at least one embodiment, the weight is injection molded.

In at least one embodiment, the weight has a total weight between about 0.1 grams and 10 grams. In at least one embodiment, the bowstring weight has a total weight between about 0.5 grams and 5 grams. In at least one embodiment, the weight has a total weight between about 2 grams and 4 grams. In at least one embodiment, the weight has a total weight of about 3 grams.

BRIEF DESCRIPTION OF THE SEVERAL VIEWS OF THE DRAWING(S)

DETAILED DESCRIPTION OF THE INVENTION

Figure 1:
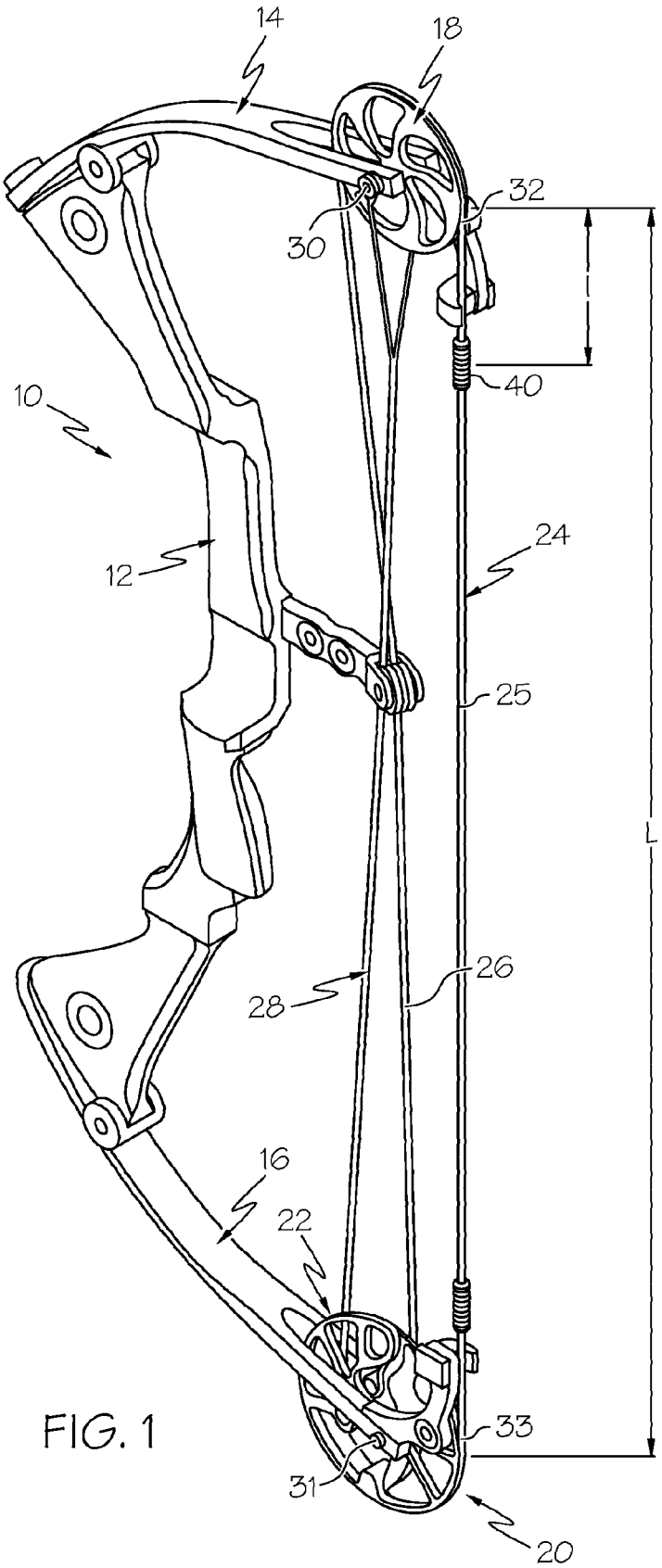
FIG. 1 shows an embodiment of the invention installed on a compound bow.

While this invention may be embodied in many different forms, there are described in detail herein specific preferred embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a compound bow 10 such as described in U.S. Pat. Nos. 5,368,006 and 6,443,139, both incorporated herein by reference. Although the present invention can be used with any suitable type of archery bow (including, but not limited to, single-cam bows, CPS bows and/or cam-and-a-half bows, dual-cam bows and/or twin-cam bows, crossbows, etc.), a bow 10 is shown in FIG. 1 as a single-cam compound bow.

As shown in FIG. 1, the bow 10 generally comprises a riser 12, a first limb 14, a second limb 16, rotatable members 18 and 20, a cam assembly 22, a first cable 24, and a second cable 28. The inner ends of limbs 14, 16 are connected at opposite ends of the riser 12. Rotatable member 18 is rotatably supported on an axle 30 near the outer end of first limb 14, and rotatable member 20 is rotatably supported on an axle 31 near the outer end of second limb 16. Each rotatable member can comprise a cam, a pulley or any other suitable rotatable member. In the embodiment shown, rotatable member 20 comprises a cam assembly 22.

The first cable 24 has a first section 25 (typically referred to as "the bowstring") and a second section 26 (typically referred to as "the control cable" in a one-cam bow). The first cable 24 extends from rotatable member 20, is trained around rotatable member 18 and extends back to terminate on the rotatable member 20. In particular, bowstring 25 can be considered the portion of the first cable 24 that an archer grasps and draws, which extends between the first and second rotatable members 20, 22. The control cable 26 portion extends between the first and second rotatable members but is not grasped by an archer. The second cable 28 (typically referred to as "the power cable") is anchored at one end to an outer portion of the first limb 14, for example being attached to the limb 14 itself, the axle 30, or in some embodiments, a portion of the rotatable member 20, for example as described in U.S. patent application Ser. No. 12/248,467, filed Oct. 9, 2008, the entire disclosure of which is hereby incorporated herein by reference. The second cable 28 is anchored at the other end to the cam assembly 22. When the archer draws the bowstring 25 back, the rotatable member of cam assembly 22 rotates and bowstring 25 is fed out from rotatable member 20. The control cable 26 is fed out from a rotatable member 18, 20 to give the bowstring 25 more cable length as the archer approaches full draw. As the bowstring 25 is fed out from the rotatable member(s) 18, 20, the power cable 28 is taken up in the cam assembly 22. The increased tension in the first cable 24 and the second cable 28 during draw shortens the distance between the rotatable members 18, 20, causing flexure of limbs 14, 16. Thus, energy is stored in the limbs of the bow, and when the bowstring is released, this stored energy is transferred to an arrow to accelerate it forward. While the above disclosure describes a single-cam compound bow, various other configurations such as CPS bows and/or cam-and-a-half bows, dual-cam bows and/or twin-cam bows, crossbows, and the like may be used.

As described above, the bowstring 25, which is a portion of the first cable 24, extends between the first and second rotatable members 18, 20. As shown in FIG. 1, bowstring 25 has a length spanning between bowstring support points 32, 33. The support points 32, 33 comprise the points where the bowstring 25 first contacts each of the first and second rotatable members 18, 20 in the undrawn state, which can also be considered the last point of the bowstring 25 that is supported by either rotatable member 18, 20.

At least one bowstring weight 40 is attached to the bowstring 25. In some embodiments, such as the one shown in FIG. 1, two bowstring weights are used, one at each end of the bow. Each bowstring weight 40 is attached at a distance l away from the bowstring support point 32, 33. Distance l is defined as the shortest distance from the center of mass of the bowstring weight 40 to the nearest bowstring support point 32, 33. In some embodiments, l is less than ⅓ of the overall length L of the bowstring 25. In a preferred embodiment, l is less than ⅕ of the overall length L of the bowstring 25.

Figure 2:
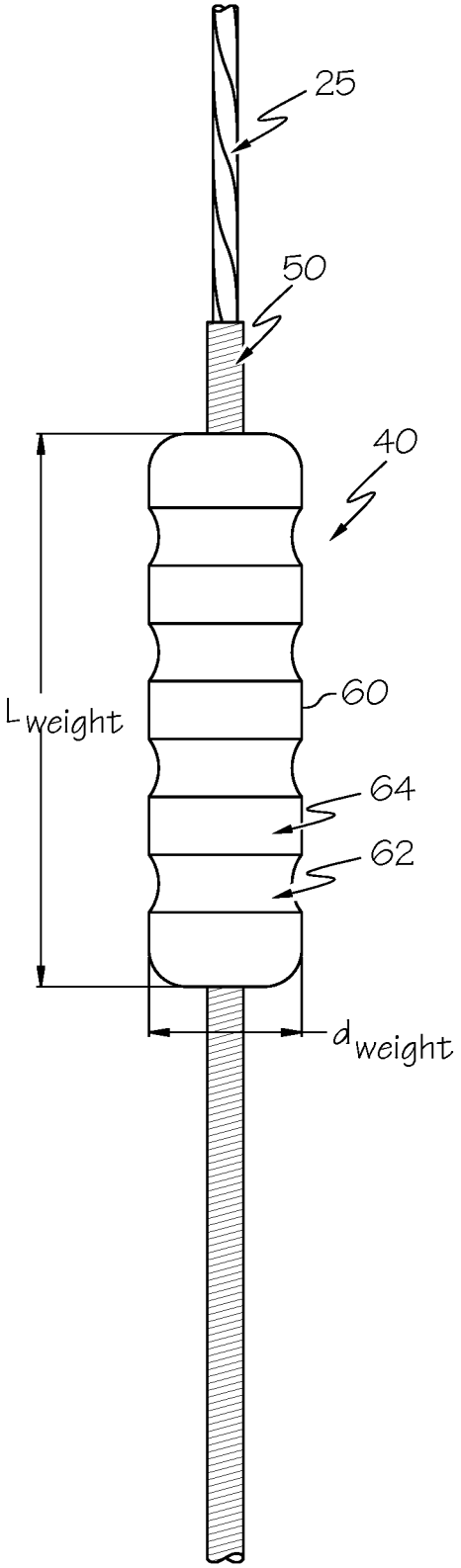
FIG. 2 shows a partial view of the bowstring of FIG. 1 showing an embodiment of the invention.

FIG. 2 shows a partial view of the bowstring 25 with a bowstring weight 40 attached to the bowstring's serving 50, which is additional thread that is wrapped around the bowstring 25 to prevent abrasion.

Figure 3:
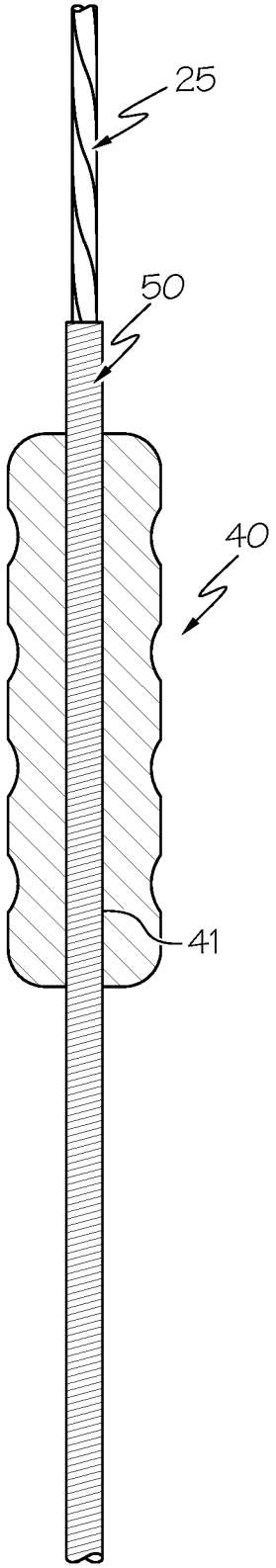
FIG. 3 shows a cross-sectional of the embodiment of the invention shown in FIG. 2.
Figure 4:
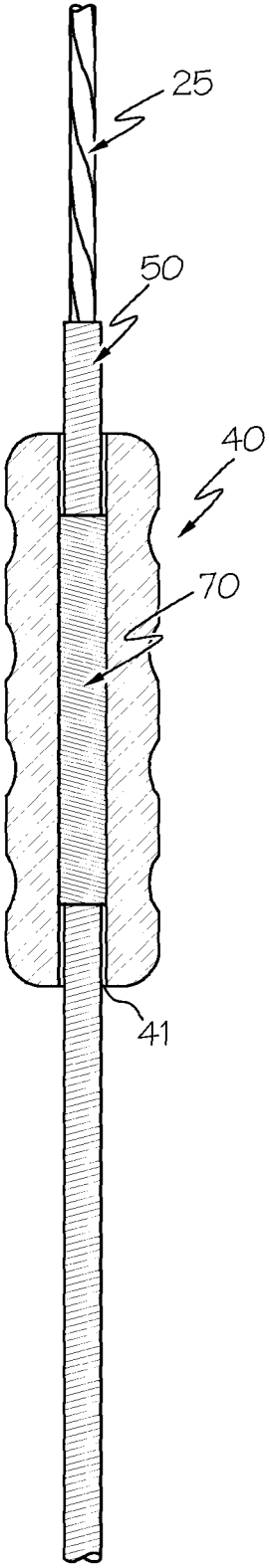
FIG. 4 shows an embodiment of the invention.
Figure 5:
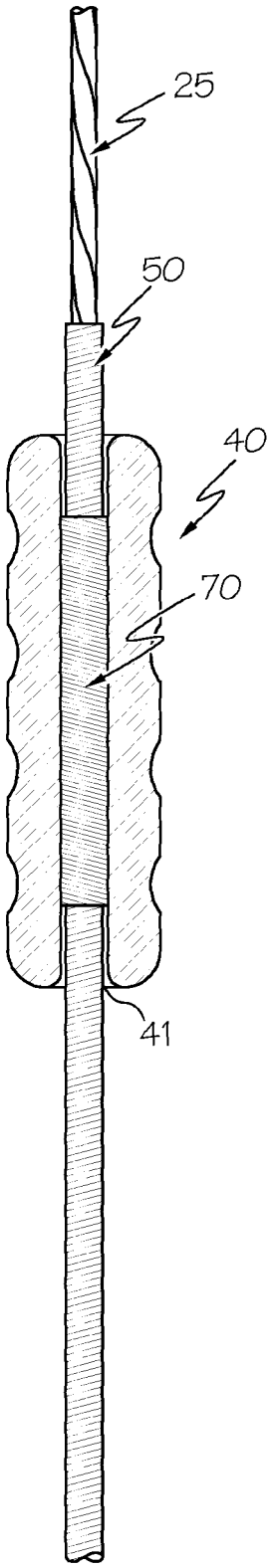
FIG. 5 shows another embodiment of the invention.

In some embodiments, the bowstring weight 40 comprises an internal cavity 41, for example spanning axially through the bowstring weight 40, as shown in FIG. 3. In some embodiments, the cavity 41 comprises an internal bore. The bowstring 25 is fed through the internal cavity 41. The bowstring weight 40 thus has a single cavity that extends over the axial length of the bowstring weight. In at least one embodiment, the cross-sectional shape and size of the internal cavity 41 is constant. In some embodiments, end portions of the internal cavity 41 may flare slightly. Thus, in some embodiments, the cross-sectional shape and size of the internal cavity 41 may be constant over a majority of the length of the bowstring weight (e.g. 60%, 70%, 80%, 85%, 90% or 95% of the length or more).

In some embodiments, the internal cavity 41 forms a friction fit with the serving 50 that substantially maintains the bowstring weight 40 at a specific location on the bowstring 25. In some embodiments, the bowstring weight 40 can be sized to frictionally engage the bowstring 25 directly, and the serving 50 can be omitted. In some embodiments, a friction fit can be supplemented with a suitable adhesive, such as cyanoacrylate. In some other embodiments, any suitable attachment method can be used, such as crimping, an adhesive, a separate fastener or the like.

In some embodiments, the bowstring weight 40 is a molded or injection molded single piece. In some embodiments, a bowstring weight 40 consists of a single piece of material. In at least one embodiment, the bowstring weight 40 is entirely formed of a single type of material. In various embodiments, the bowstring weight 40 can comprise any suitable material(s), preferably polymers, such as rubber, neoprene, nylon, PVC, polystyrene, polyethylene, polypropylene, polyacrylonitrile, PVB, silicone, elastomers and/or combinations thereof. In some embodiments, this material has a desired density that correlates with a desired weight of the bowstring weight 40. In some embodiments, the material is resilient enough to have the bowstring pulled through the internal bore 41, but rigid enough to provide resistance to bending along the length of the bowstring weight 40.

The weight of the bowstring weight 40 may be varied by changing the length $l_{weight}$ and the diameter $d_{weight}$ of the bowstring weight 40, such that the volume of material used in the bowstring weight increases or decreases. In at least one embodiment, the total weight of the bowstring weight 40 is between about 0.1 grams and 10 grams. In some embodiments, the total weight of the bowstring weight 40 is between about 2 grams and about 5 grams. In some preferred embodiments, the total weight of the bowstring weight 40 is approximately 2.6 grams. A person of ordinary skill in the art would recognize that the preferred weight of the bowstring weight 40 can change based upon the specific characteristics of the bow.

The bowstring weight 40 may have any suitable shape. In some embodiments, the bowstring weight 40 is a cube, a rectangular prism, a cylinder, or a sphere. In some embodiments, the bowstring weight 40 has an outer wave-like profile 60 along the length of the bowstring weight, as shown in FIG. 2. This wave-like profile is created by having at least one first portion 62 and one second portion 64 alternatively arranged longitudinally along the bowstring, wherein the first portion 62 and the second portion 64 have distinguishable shapes. For example, the first portion 62 has a smooth concave shape and the second portion 64 has a substantially cylindrical shape. By using a wave-like profile, the total weight of the bowstring weight 40 can be visually determined by counting the total number of the first portion 62 and the second portion 64, which each correspond to a given weight.

The bowstring weight 40 can also be modified to achieve a desired weight. For example, a bowstring weight 40 may be provided having several segments, such as first portions 62 and second portions 64. If less weight is needed, a user can remove various segments, for example by cutting the bowstring weight 40.

In some embodiments, the bowstring 25 can be provided with a spacer 70 to increase the size of the bowstring 25 and help provide for a friction fit between the bowstring weight 40 and the spacer 70. In some embodiments, a spacer 70 can be used over the serving 50. The spacer 70 can comprise any suitable material and may be of any suitable shape. In some embodiments, the bowstring spacer 70 may comprise a tubular structure made of any suitable materials, such as a polymer, metal or fabric. In some embodiments, the spacer 70 comprises an additional wrap of serving material, which can be installed over a base layer of serving 50.

In some embodiments, the bowstring spacer 70 may engage the internal cavity 41 to facilitate the bowstring weight 40 remaining in a fixed location along the bowstring 25.

In some embodiments, the shape of a bowstring weight 70 remains substantially identical prior to installation on a bowstring 25 and after installation on a bowstring 25.

The bowstring weight 40 can be used with any suitable archery bows, such as compound bows.

The invention is also directed to methods of forming a bowstring weight 40 as described herein, as well as methods of making a bow comprising a bowstring weight 40 as described herein. For example, a portion of an archery bow can be provided that comprises all parts of an archery bow except for a bowstring. A bowstring can also be provided. The bowstring weight 40 can be provided and installed on the bowstring, for example by pulling the bowstring 25 through the cavity 41 of the weight 40. The bowstring can then be installed on the bow portion.

A location of the weight 40 on the bowstring can further be adjusted after the bowstring 25 is installed on the bow.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having other possible combination of the features of the dependent claims. For instance, for purposes of claim publication, any dependent claim which follows should be taken as alternatively written in a multiple dependent claim if such multiple dependant format is an accepted format within the jurisdiction (e.g. each claim depending directly from claim 1 should be alternatively taken as depending from all pervious claims). In jurisdiction where multiple dependant claims formats are restricted, the following dependent claims should each be taken as alternatively written in each singly dependent claim format which creates a dependency from a prior antecedent-possessing claim other than the specific claim listed in such dependant claim below.

This completes the description of the preferred and alternate embodiments of the invention. Those skilled in the art may recognize other equivalents to the specific embodiments described herein which equivalents are intended to be encompassed by the claims attached hereto.

The invention claimed is:

1. A method comprising:

providing a bowstring;

providing a weight comprising a tubular body comprising a polymeric material, said tubular body comprising a plurality of segments separated by recessed portions, said tubular body comprising at least three of said recessed portions; and attaching said weight to said bowstring.

2. The method of claim 1, said bowstring comprising a serving, said weight contacting the serving.

3. The method of claim 1, wherein said providing a weight comprises molding said weight.

4. The method of claim 1, wherein said attaching said weight to said bowstring comprises pulling said bowstring through a cavity defined by said tubular body.

5. The method of claim 1, wherein said weight weights 2 grams or less.

6. The method of claim 1, said bowstring constructed and arranged for use in a compound bow having a first rotatable member and a second rotatable member, the bowstring having a length and defining a first support point and a second support point, wherein a distance between said weight and said first support point is less than one-third of a distance between the first support point and the second support point.

7. The method of claim 1, said weight comprising a first weight, the method comprising providing a second weight and attaching said second weight to said bowstring.

8. The method of claim 7, wherein the first weight and the second weight have the same shape.

9. The method of claim 1, comprising installing said bowstring on a compound bow.

10. A method comprising:

providing a bowstring constructed and arranged for use in a compound bow having a first rotatable member and a second rotatable member, the bowstring having a length and defining a first support point and a second support point;

providing a weight comprising a tubular body comprising a polymeric material; and attaching said weight to said bowstring wherein a distance between said weight and said first support point is less than one-third of a distance between the first support point and the second support point.

11. The method of claim 10, said bowstring comprising a serving, said weight contacting the serving.

12. The method of claim 10, wherein said providing a weight comprises molding said weight.

13. The method of claim 10, wherein said attaching said weight to said bowstring comprises pulling said bowstring through a cavity defined by said tubular body.

14. The method of claim 10, wherein said weight weights 2 grams or less.

15. The method of claim 10, said weight comprising a first weight, the method comprising providing a second weight and attaching said second weight to said bowstring.

16. The method of claim 15, wherein the first weight and the second weight have the same shape.

17. The method of claim 15, wherein a distance between said second weight and said second support point is less than one-third of the distance between the first support point and the second support point.

18. The method of claim 10, comprising installing said bowstring on said compound bow.

* * * * *